US006390466B1

(12) United States Patent
Sanmiya

(10) Patent No.: US 6,390,466 B1
(45) Date of Patent: May 21, 2002

(54) TRAY DEVICE FOR SHEET HANDLING SYSTEM

(75) Inventor: Shigeyuki Sanmiya, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 09/591,469

(22) Filed: Jun. 9, 2000

(30) Foreign Application Priority Data

Jun. 11, 1999 (JP) ..... 11-165947

(51) Int. Cl.[7] ..... B65H 31/04
(52) U.S. Cl. ..... 271/213; 271/214
(58) Field of Search ..... 271/207, 213, 271/214, 215, 217, 219, 147, 160, 163, 162

(56) References Cited

U.S. PATENT DOCUMENTS 4,012,036 A * 3/1977 Sokol ..... 271/215
4,260,148 A * 4/1981 Diesch et al. ..... 271/219
4,664,507 A * 5/1987 Fukae et al. ..... 271/217 X
4,718,657 A * 1/1988 Otter et al. ..... 271/184
5,415,390 A * 5/1995 Guerrero ..... 271/215
5,618,035 A * 4/1997 Coombs et al. ..... 271/213

* cited by examiner

*Primary Examiner*—David H. Bollinger
(74) *Attorney, Agent, or Firm*—Pitney, Hardin, Kipp & Szuch LLP

(57) ABSTRACT

A tray member incorporated in a tray device is movable vertically in parallel in accordance with the thickness of sheets fed from a sheet handling system, so as to easily attach the tray device to the sheet handling system such as an image forming device, copying machine, printer and sheet post-processing apparatus for automatically stapling sheets. A driving mechanism for vertically moving the tray member is simple in structure, so that it can be incorporated compactly within the tray member. A low-power driving mechanism suffices for vertically moving only the tray member, so that the driving mechanism can be efficiently operated even with small power. The tray device has all the component elements including the driving mechanism built-in, so as to impose little structural restrictions on the sheet handling system to which the tray device is united.

9 Claims, 9 Drawing Sheets

M
100
101
XI
X
20
32a
23
32
33
31
35A
(35)
34
10
110
102

TRAY DEVICE FOR SHEET HANDLING SYSTEM

BACKGROUND OF THE INVENTION

1. Field of the Invention

This invention relates to a tray device capable of being easily united to a sheet handling system such as a copying machine and a sheet post-processing apparatus, and more particularly, to a tray device incorporating compactly a mechanism for moving vertically a sheet supporting plane in parallel in accordance with the thickness of sheets fed from the sheet handling system.

2. Description of the Prior Art

Sheet handling systems such as a sheet post-processing apparatus and a sheet sorting device, which are generally united to an image forming apparatus such as a copying machine, printer and facsimile, are provided with a sheet tray for holding and stacking sheets thereon. The sheet tray of a large storage type capable of stacking a large number of sheets has a large mechanism for vertically moving a sheet supporting plane in accordance with the number of sheets stacked therein.

The mechanism for vertically moving the tray incorporated in the sheet post-processing apparatus as described in U.S. Pat. No. 3,385,340 is composed of a rack formed on a device frame, a pinion engaged with the rack, and a motor mounted on the tray. In this prior art device, by driving the motor to rotate the pinion, the tray is moved vertically while being guided by use of guiding rollers along a guiding rail fixed on the device frame. There have also been various tray devices employing a tray moving mechanism having lifting belts instead of the rack and pinion.

In the tray device of any type having the driving components including rack and guiding elements, the counterpart components of the driving mechanism should be fixedly formed in advance on a sheet handling system to which the tray device is united, and therefore, requires a large-sized subsidiary means for moving the tray vertically, resulting in a large overall size of the sheet handling system.

The tray in the conventional tray device of the type driven by a driving motor has been heavy, thus burdening the driving motor in the mechanism for vertically moving the tray with heavy weight. As a result, the high-power driving motor being large in size and weight must be used for moving the heavy tray. Consequently, the motor becomes difficult of incorporation into the tray device and entails a disadvantage such that it must be assembled within the sheet- handling system to which the tray device is united. As is obvious from the circumstances, the conventional tray device has been used exclusively for a specific sheet handling system, but cannot be attached additionally to another existing system without any mounting means.

OBJECT OF THE INVENTION

An object of the present invention is to provide a tray device for stacking thereon one or more sheets fed from a sheet handling system such as a sheet post-processing apparatus, which has a sheet supporting plane capable of being effectively moved vertically in parallel in accordance with the thickness of sheets stacked thereon.

Another object of the present invention is to provide a tray device capable of being efficiently operated even by a low-power driving motor producing having small motion power for lifting only the sheet supporting plane.

Still another object of the present invention is to provide a tray device having a wide use easily applicable to various sheet handling systems.

SUMMARY OF THE INVENTION

To attain the objects described above, there is provided a tray device comprising a tray member movable vertically relative to a device frame, and a tray driving means incorporated within the device frame for vertically moving the tray member.

The device frame is fixedly or demountably united to the sheet handling system. The tray driving means comprises a stationary gear fixed on the device frame, a movable gear fixed on the tray member, a planet gear placed between the stationary gear and the movable gear, and a tray lifting means for vertically moving the tray member. The rotating shafts of the stationary, movable and planet gears are linked together by a rocking arm member rotatable on the rotating shaft of the stationary gear. The stationary and movable gears may be formed of a sector gear, respectively.

As the tray lifting means, an electric motor for rotating the planet gear may be used.

The motor is driven in accordance with the amount of sheets fed onto the tray member, thereby to rotate the planet gear relative to the stationary gear, with the result that the movable gear revolves vertically round the rotating shaft of the stationary gear, consequently to move vertically the tray member in parallel.

In place of the motor serving as the tray lifting means, there may be used a spring having such a spring constant that it expands or contracts in accordance with the weight of the sheets stacked on the tray member.

The tray driving means for vertically moving the tray member in parallel can be incorporated compactly within the device frame, consequently diminishing the size and weight thereof. Thus, the tray device of the invention can be driven with high efficiently even by using a low-power motor, and can exactly deal with and store the sheets. According to the invention, there is no call for mounting a driving mechanism for vertically moving the tray member onto the sheet handling system, and therefore, the tray device can be applied to various sheet handling systems of any type.

Other objects and features of the present invention will be hereinafter explained in detail with reference to the accompanying drawings.

DESCRIPTION OF THE PREFERRED EMBODIMENTS

This invention relates to a tray device provided with a tray member having a sheet supporting plane capable of vertically moving in accordance with the amount of sheets fed from an image forming device such as a copying machine or a sheet handling system such as a sheet post-processing apparatus by which the sheets discharged from the image forming device are stapled automatically. Even though the tray device of this invention has a tray moving mechanism for the tray member built-in, it can easily be united to various sheet handling systems without need to provide the sheet handling system with the tray moving mechanism.

Figure 1:
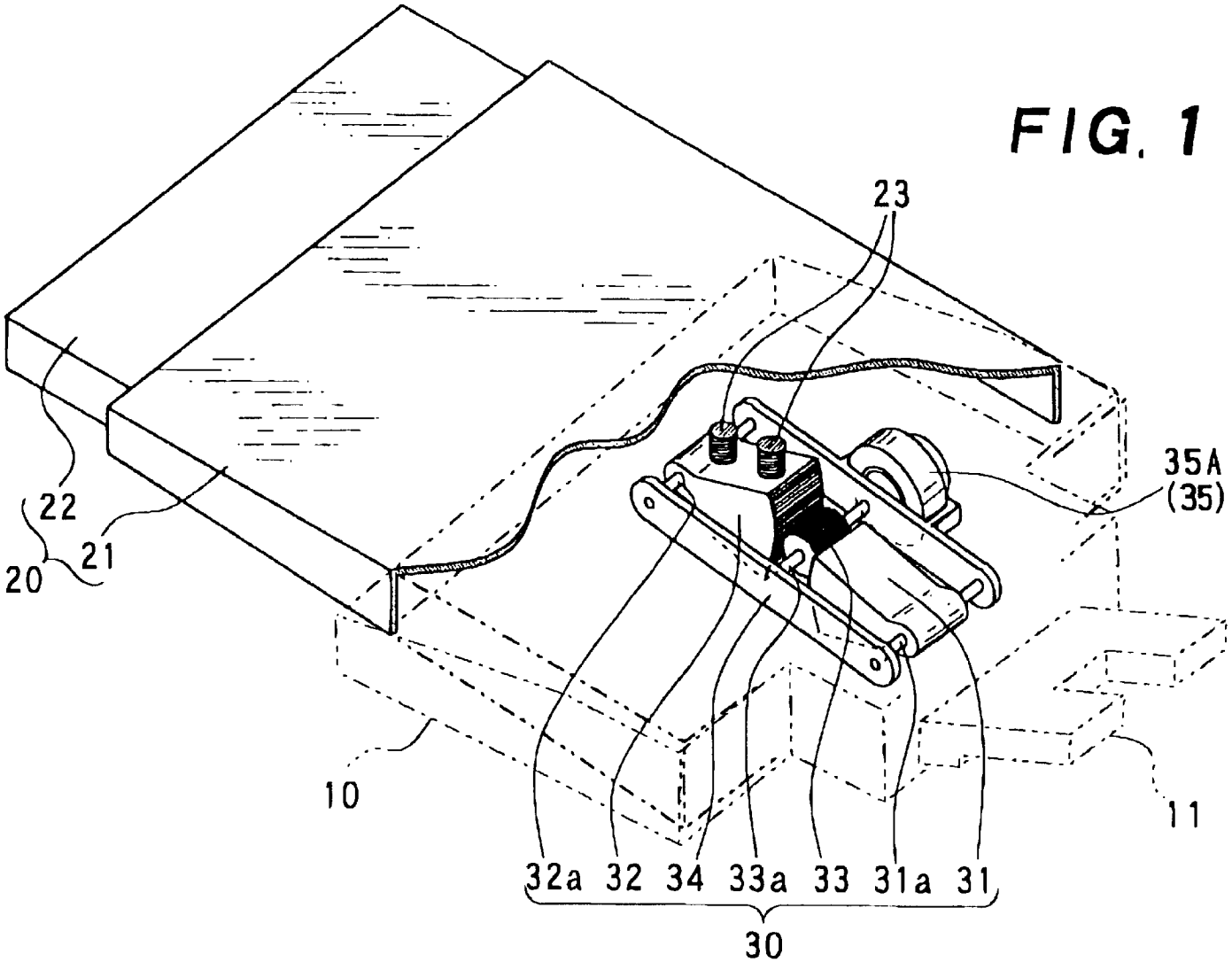
FIG. 1 is a partial cutaway perspective view schematically showing the principal driving system of one embodiment of a tray device according to this invention.
Figure 3:
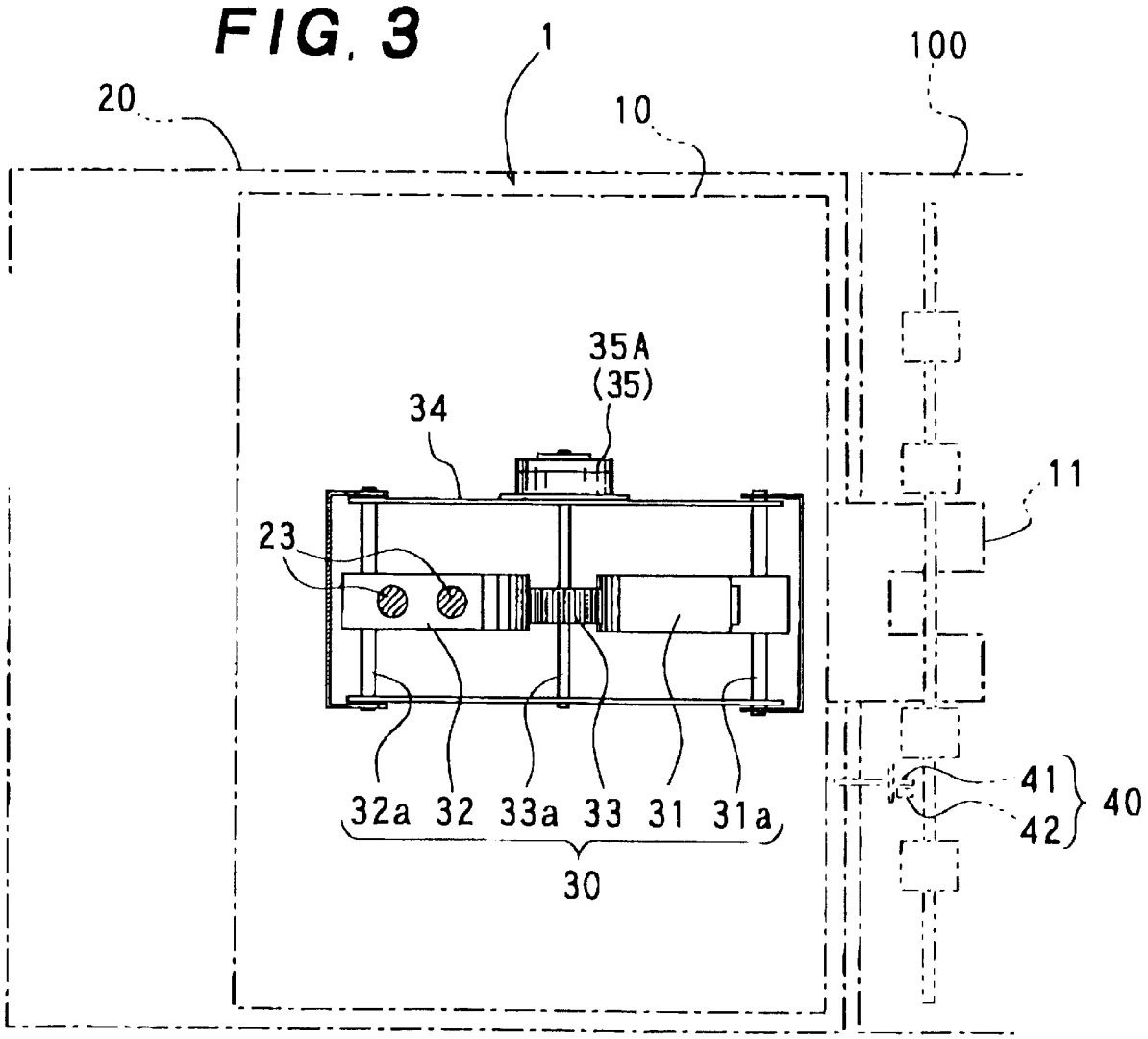
FIG. 3 is a schematic plan view showing the tray device of FIG. 2.

As shown in FIG. 1 and FIG. 3, the tray device 1 of this invention comprises a device frame 10 which is attached to the sheet handling system 100 by means of a fitting member 11, a tray member 20 movable vertically in parallel relative to the device frame 10, and a tray driving means 30 for vertically moving the tray member 20, which is incorporated within the device frame 10.

The device frame 10 in the illustrated embodiment is demountably attached to the sheet handling system 100, but not necessarily be demountable. That is, the device frame 10 may be fixed to the sheet handling system 100 in accordance with necessities of use. Also, in the case of using the fitting member 11 as shown in the illustrated embodiment, it is required to construct a structure for receiving the fitting member 11 on the sheet handling system 100. However, even if such a receiving structure is not formed on the sheet handling system 100, the tray device of the invention can easily be mounted to the sheet handling system of any type having no receiving structure by forming an adequate mounting structure on the sheet handling system.

Incidentally, the tray device of this invention is fundamentally attached to the sheet post-processing apparatus such as the copying machine, but this invention does not contemplate imposing any limitation on the article to which the tray device of the invention is applied. That is, the tray device of the invention can be applied to various types of systems which deal with sheets or sheet-like materials.

The tray member 20 in the illustrated embodiment has the sheet supporting plane 21 for stacking one or more sheets thereon. The sheet supporting plane 21 is vertically movable in parallel relative to the device frame 10 so as to change its height in accordance with the thickness of sheets fed thereonto.

The tray member 20 is not necessarily an indispensable constituent of the invention. The tray member in this embodiment is provided with an auxiliary telescopic tray 22 so as to freely elongate the sheet supporting plane 21 practically for dealing with long size sheets.

The tray driving means 30 for vertically moving the tray member 20 relative to the device frame 10 comprises a stationary gear 31 fixed on the device frame 10, a movable gear 32 which is fixed on the tray member 20 by using a supporting member 23, a planet gear 33 placed between the stationary gear 31 and the movable gear 32, a rocking arm member 34 which is rotatable on the rotating shaft 31*a* of the stationary gear held on the device frame 10, and a tray lifting means 35 for vertically moving the tray member. The rotating shafts 32*a* and 33*a* of the movable and planet gears 32 and 33 are linked to the rotating shaft 31*a* of the stationary gear 31 by a rocking arm member 34.

The tray lifting means 35 in this embodiment is formed of an electric motor 35A for rotating the planet gear 33 held by the rocking arm member 34.

On the rocking arm member 34, there is disposed a lower-limit sensor 36 opposite to one side of the stationary gear 31, so that the lower-limit sensor detects a sensing element 31d attached to the stationary gear 31 when the rocking arm member 34 reaches its lower limit point, and an upper-limit sensor 37 opposite to one side of the movable gear 32, so that the upper-limit sensor detects a sensing element 32*d* attached to the movable gear 32 when the rocking arm member 34 reaches its upper limit point. Thus, the upper and lower limit positions of the rocking arm member can be discerned. Each of the sensors 37 and 38 is formed of a photo sensor in this embodiment, but it is by no means limited thereto and may be formed of a lead switch, a micro switch with an operation lever or any other switching means.

Figure 4:
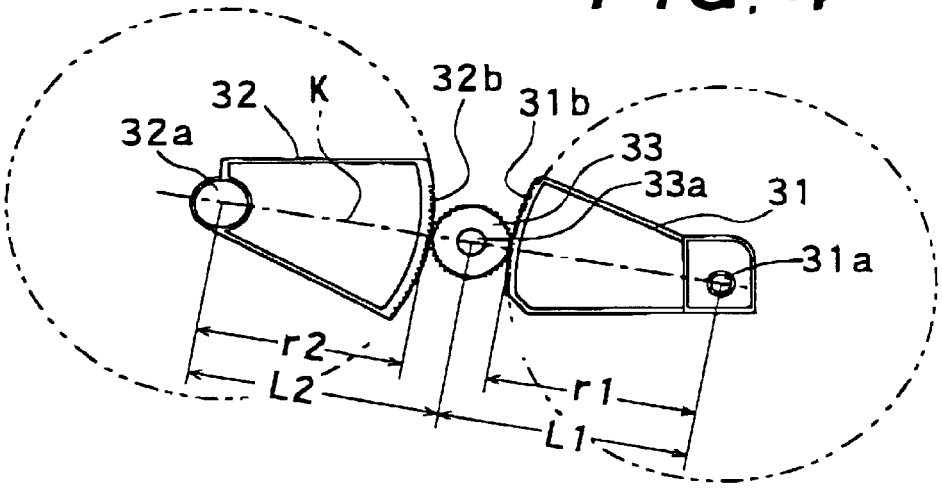
FIG. 4 is a conceptual view showing the relation among gears constituting a driving system of the invention.

The stationary gear 31 is a sector gear with a train of gear teeth 31*b* arranged in an arc having a central rotating shaft 31*a*. The movable gear 32 is a sector gear with a train of gear teeth 32*b* aligned in an arc having a central rotating shaft 32*a*. The stationary and movable gears 31 and 32 are equal in pitch circle radius (r1=r2 in FIG. 4). The pitch circle radius of the planet gear 33 is not limitative. The rotating shafts 31, 32*a* and 33*a* of the stationary, movable and planet gears 31, 32 and 33 are arranged on the center line K of the rocking arm member 34. Thus, the span L1 between the shafts 31*a* and 33*a* is equal to the span L2 between the shafts 32*a* and 33*a* (L1=L2).

Figure 5:
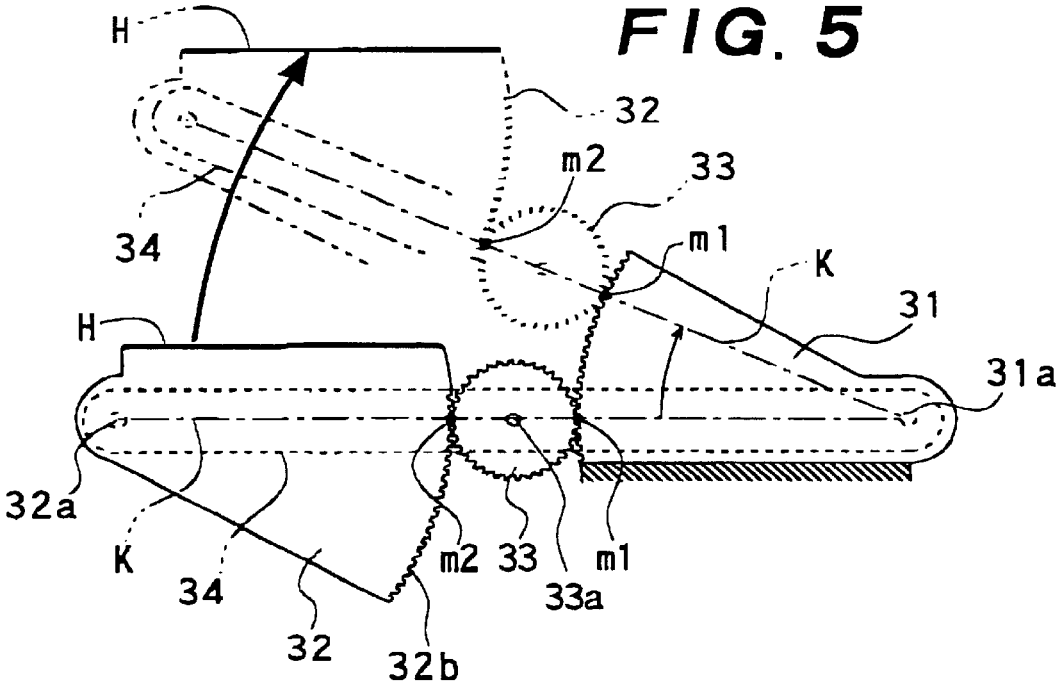
FIG. 5 is a conceptual view showing the operating principle of the tray device of this invention.

When the rocking arm member 34 dine K) revolves about the stationary rotating shaft 31*a,* the movable gear 32 changes its height without changing its posture. That is, the movable gear moves in parallel around the shaft 31*a.* The movable gear 32 shown in the schematic diagram of FIG. 5 provisionally has a horizontal basic plane H in an easily understandable manner. As illustrated, on the center line K, there are aligned at all times the rotating shafts 31*a,* 33*a* and 32*a,* a contact point m1 between the stationary gear 31 and the planet gear 33, and a contact point m2 between the planet gear 33 and the movable gear 32. The relation in position among those components does not change even when the center line K rotates on the shaft 31*a.* Although the rotating shaft 32*a* of the movable gear 32 varies its height as the center line K rotates on the shaft 31*a,* the contact point between the gear teeth train 32*b* and the planet gear 33 varies with rotating the rocking arm member so as to keep the movable gear 32 in the horizontal posture. That is, the basic plane H of the movable gear 32 does not change its inclination.

Therefore, the tray member 20 united with the movable gear 32 in the tray device of the invention in no way changes its posture even when the rocking arm member 34 rotates on the shaft 31*a* to what degree, thus moving vertically the sheet supporting plane 21 in parallel without changing the inclination of the sheet supporting plane.

Figure 6A:
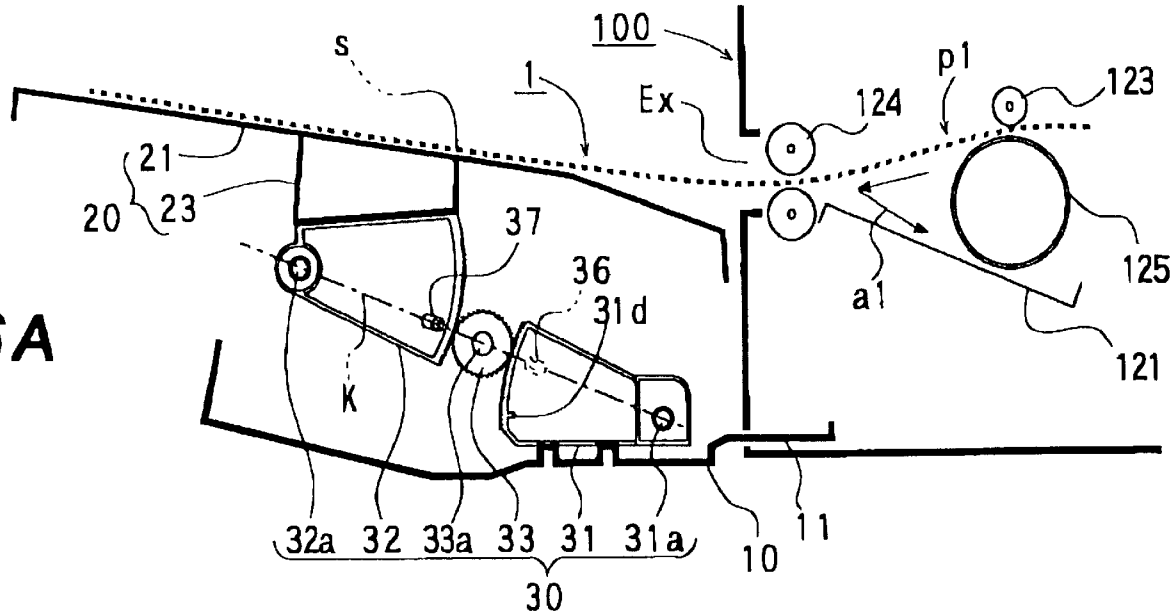
FIG. 6A and FIG. 6B are explanatory diagrams illustrative of the operating principle of the tray device of FIG. 1.
Figure 6B:
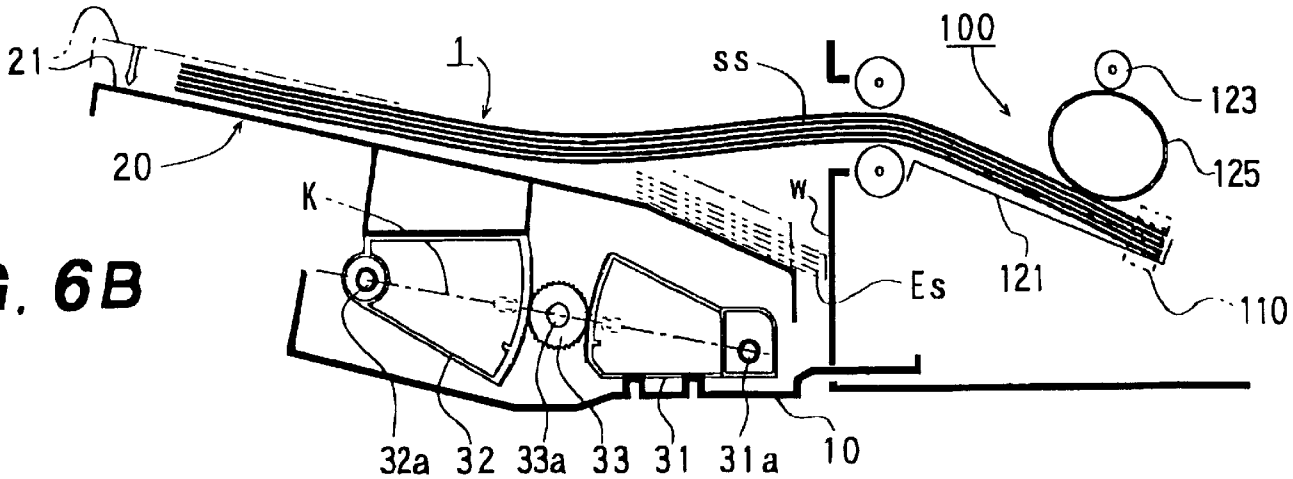

In the case of applying the tray device 1 having the aforementioned structure to the sheet handling system 100, the sheet supporting plane 21 of the tray member 20 is movable vertically in parallel in accordance with the thickness of the sheets fed thereonto from the sheet handling system 100 as illustrated in FIG. 6A and FIG. 6B.

In the initial state in which no sheet is placed on the sheet supporting plane 21, the sheet supporting plane 21 of the tray member 20 assumes its upper limit position as shown in FIG. 6A. To bring the tray member 20 to its upper limit position, the motor 35 is operated to rotate the planet gear 33 until the upper-limit sensor 37 detects the tray member 20.

The sheet s fed from the sheet post-processing apparatus serving as the sheet handling system 100 is forwarded along the sheet supporting plane 21 as indicated by a dotted line in FIG. 6A. In a case that sheets ss stacked on the tray member 20 are aligned at their tail ends inside the sheet post-processing apparatus and automatically bound by using a stapling unit 110 as presumed in FIG. 6B, the level of the uppermost sheet of the stacked sheets must be maintained at the prescribed height at all times. The tray member 20 in the tray device of this invention is driven to move the sheet supporting plane 21 downward in parallel in accordance with the thickness of the sheets stacked thereon so as to constantly bring the uppermost sheet of the stacked sheets to the prescribed height.

The thickness of the stacked sheets fed onto the tray member 20 can be discerned by counting the number of sheets discharged from the sheet handling system 100 or disposing a level sensor or counter for detecting the height of the stacked sheets on the tray device 1. If the dimensions of the sheet to be dealt with is known, the height of the stacked sheets may be calculated by use of a weight sensor or the like.

Figure 2:
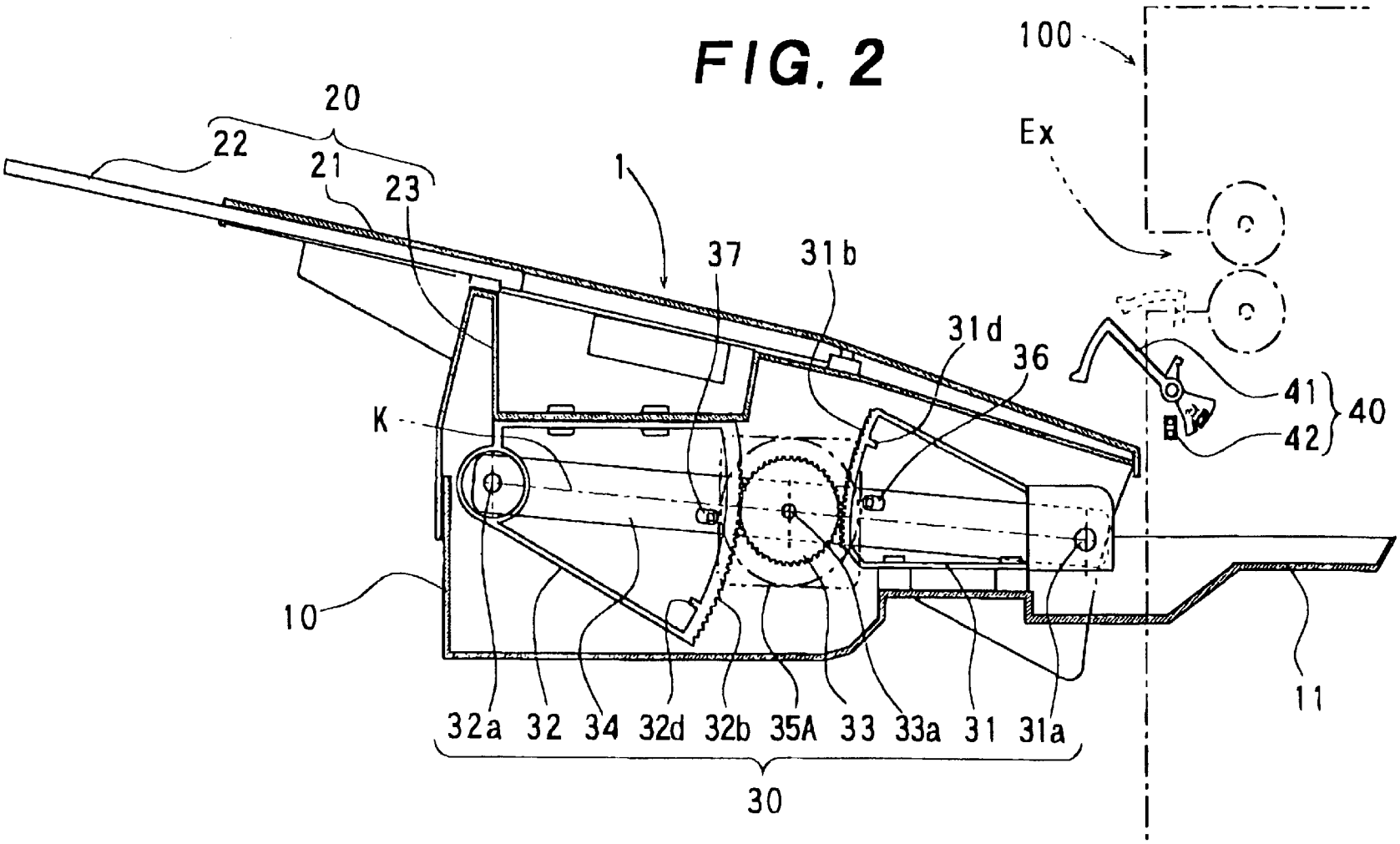
FIG. 2 is a partially sectioned side view schematically showing the tray device of FIG. 1.

The sheet handling system 100 shown in FIG. 2 by way of example is provided at its discharge portion Ex with a sheet level sensor 40. This sheet level sensor 40 comprises a sensor lever 41 which is moved by the sheet passing through the sheet discharge portion Ex, and a detector element 42 which detects movement of the sensor lever 41. Each time the sheet passes through the discharge portion, the sheet level sensor 40 issues a sheet detection signal. Upon reception of the sheet detection signal from the sensor 40, the motor 35 in the tray device 1 is operated to move downward the sheet supporting plane 21 by the thickness of one sheet.

The sheet level sensor 40 may be incorporated in the tray device 1. By positively moving the aforesaid sensor lever 41 by use of an actuator, the sheets stacked on the tray member 20 can be held steadily with a pressure force brought about by the sensor lever.

In the state of uniting the tray device 1 of the invention to the sheet handling system 100 with the fitting member 11, the outer wall w on the sheet discharge side of the sheet handling system 100 serves as a sheet aligning reference plane with which the tail edges of the sheets stacked on the tray device are trued up, as shown in FIG. 6B. Namely, the sheets stacked on the tray device are slid down along the sheet supporting plane to bring the tail edges of the sheets into collision with the outer wall w of the sheet handling system 100, consequently to align the sheets in the longitudinal direction. In a case of applying the tray device of the invention to a sheet feeder, the outer wall w serves as a reference plane for sending out the sheet from the sheet feeder.

An electric power for operating the electric motor of the tray lifting means 35 may be supplied from an external power source directly to the tray device 1 of the invention independent of the sheet handling system 100, or the electric power supplied to the sheet handling system 100 may be used for operating the motor of the tray lifting means. In the case of supplying the electric power from the sheet handling system 100 to the tray device 1, the fitting member 11 of the tray device may be provided with an electric connector (not shown), and the sheet handling system 100 is also provided with a counterpart electric connector, so as to automatically establish an electrical connection between the tray device 1 and the sheet handling system 100 when uniting the tray device to the sheet handling system.

Figure 7:
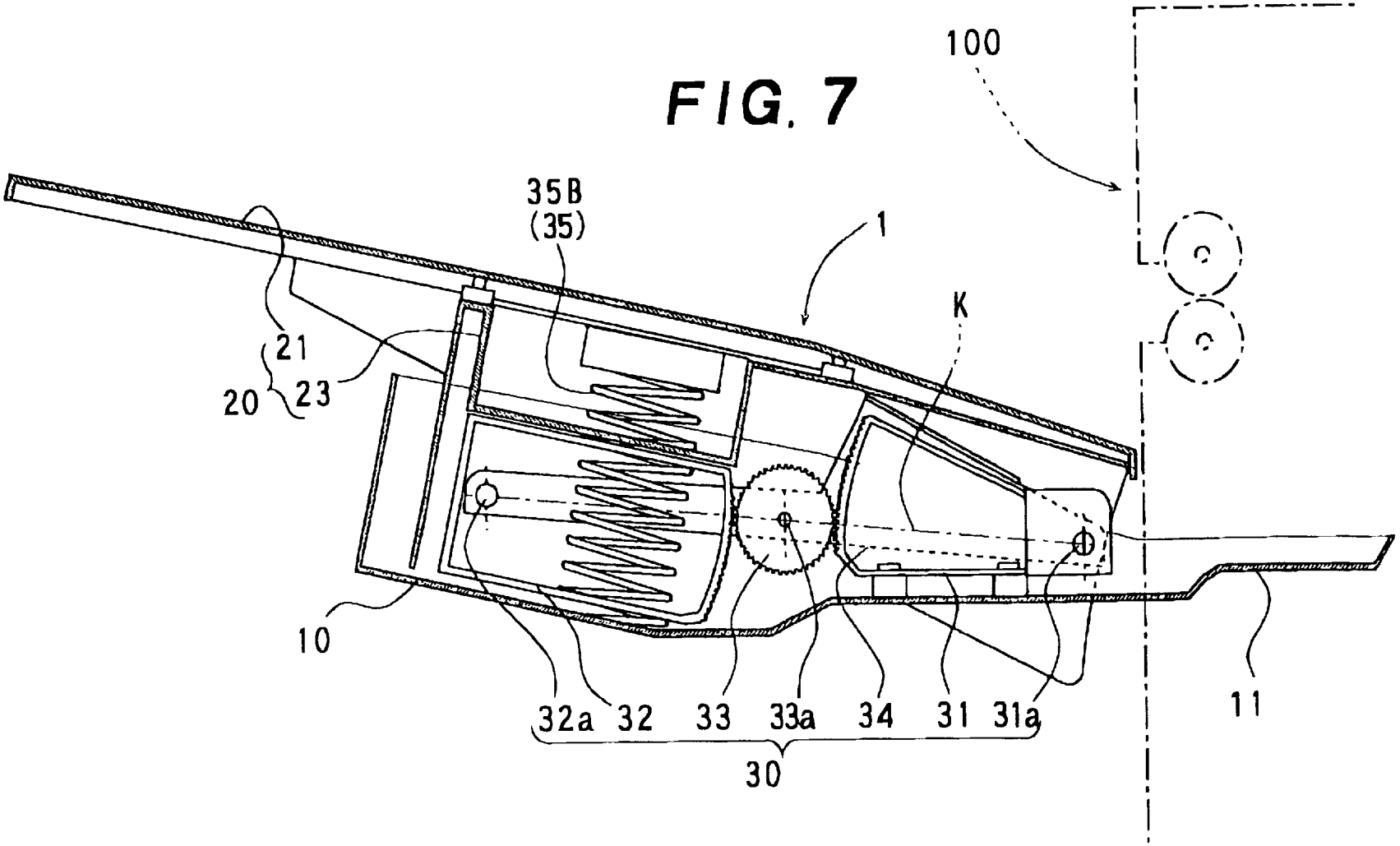
FIG. 7 is a schematic side section showing another embodiment of the tray device according to this invention.
Figure 8:
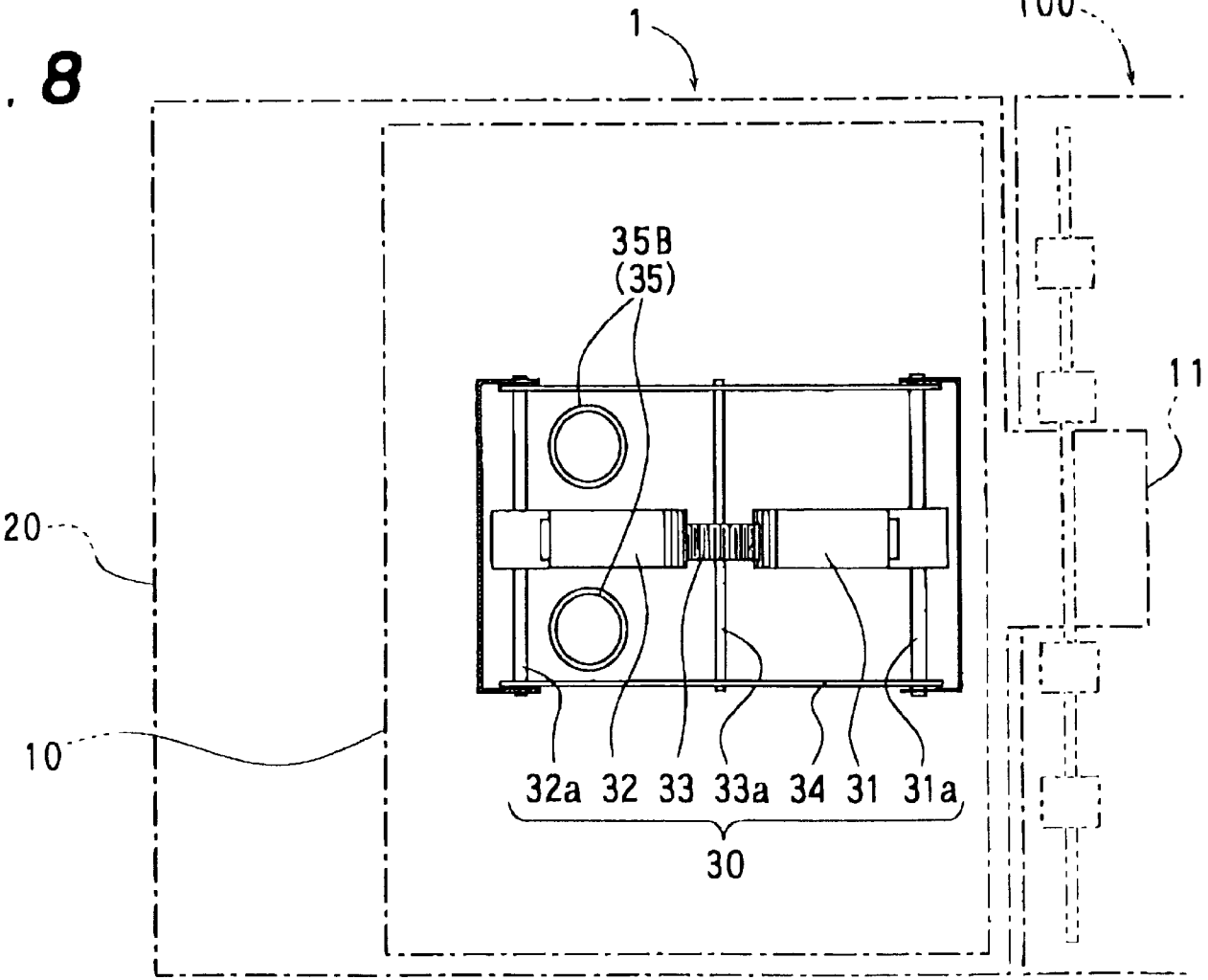
FIG. 8 is a schematic plan view showing the tray device of FIG. 7.

Although the tray lifting means 35 employs the electric motor 35A in the foregoing embodiment, a spring 35B may be used instead of the motor as shown in FIGS. 7 and 8. The spring 35B in this embodiment has such a spring constant that it expands or contracts in accordance with the weight of the sheets stacked on the tray member. The embodiment of FIGS. 7 and 8 comprises the device frame 10, tray member 20 and tray driving means 30 similarly to the foregoing embodiment. The component elements in this embodiment are somewhat modified in comparison with the foregoing embodiment, but substantially the same as those in the foregoing embodiment. Accordingly the identical or similar components of this embodiment are denoted by like numerical symbols with respect to those of the foregoing embodiment, thus to omit the description thereof hereinbelow to avoid repetition.

The tray device using the spring 35B need not use an electric power and a controller for detecting the sheet, and is simple in structure, so that it can be made small in size and light in weight.

Figure 9:
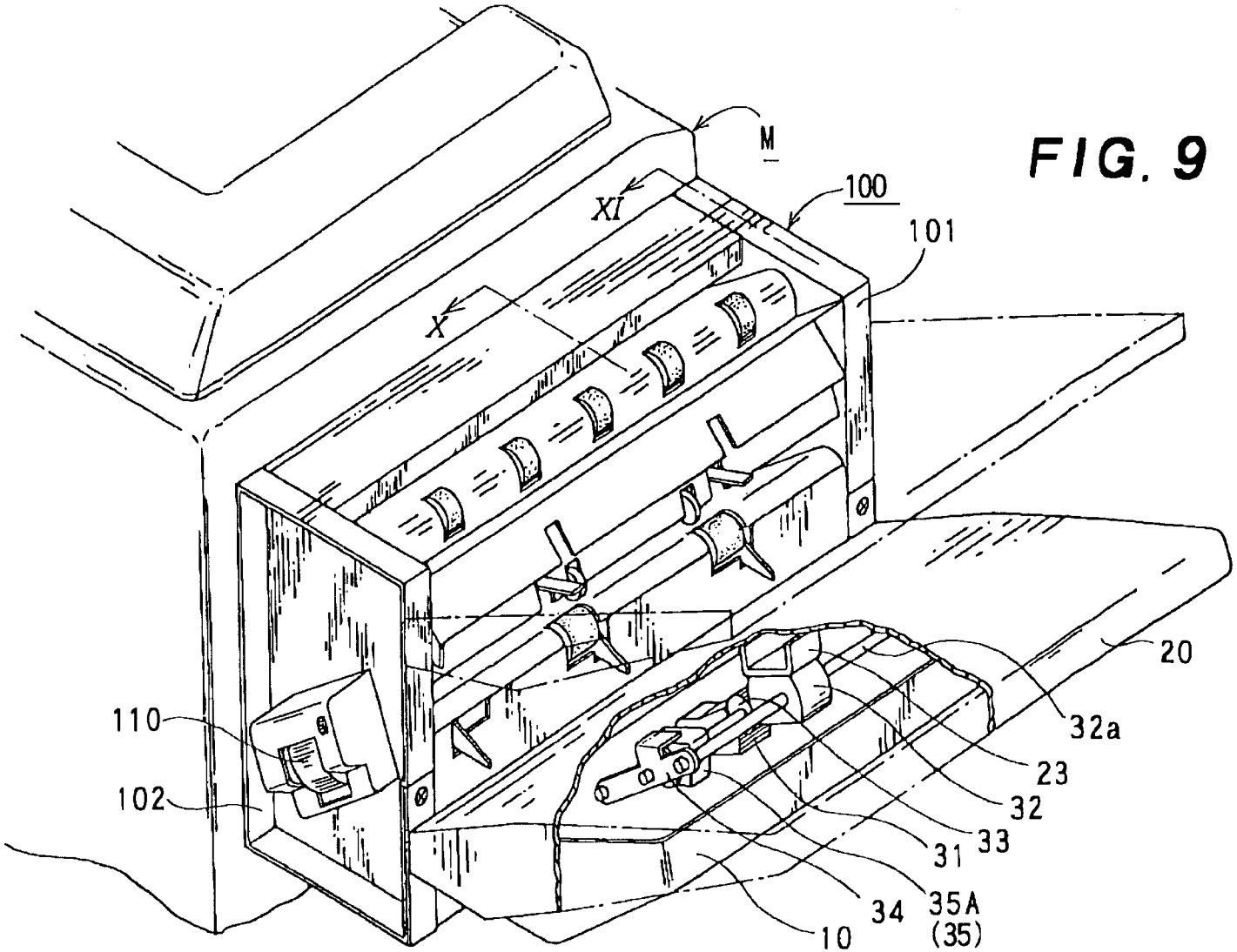
FIG. 9 is a partial cutaway perspective view showing the tray device united to a sheet handling system by way of example.
Figure 10:
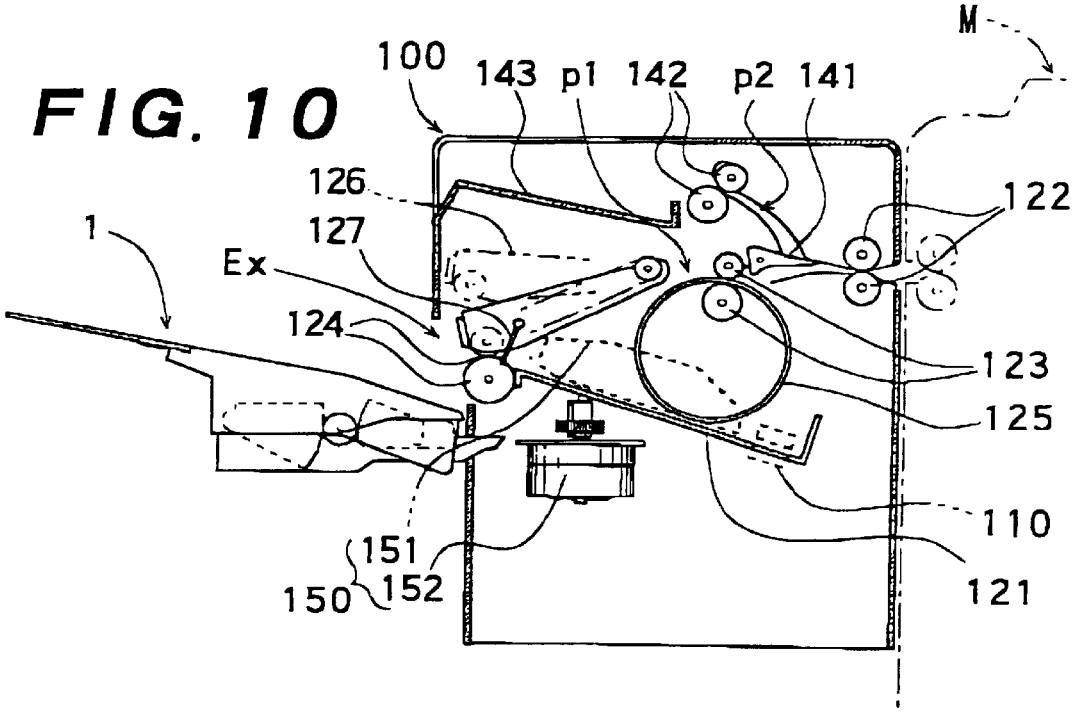
FIG. 10 shows a sectional view taken along the line X—X in FIG. 9, showing the sheet handling system with the tray device of this invention.
Figure 11:
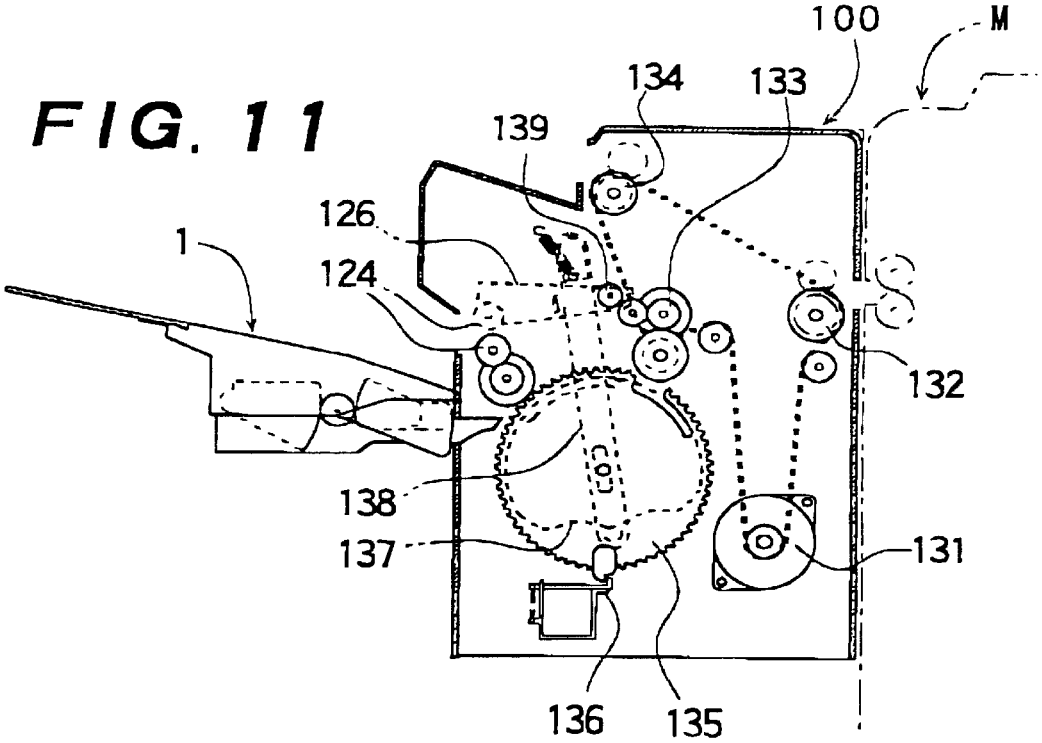
FIG. 11 shows a sectional view taken along the line XI—XI in FIG. 9, showing the sheet handling system with the tray device of this invention.

As one example of the sheet handling system 100 to which the tray device of this invention is suitably applicable, a sheet post-processing apparatus is illustrated in FIG. 9 through FIG. 11, though the sheet handling system to which the invention is applied is not specifically limited to that illustrated. FIG. 9 shows the state of uniting the sheet post-processing apparatus 100 to an image forming device M such as a copying machine when viewed from the back at an oblique angle. FIG. 10 is a view taken along the line X—X in FIG. 9, and FIG. 11 is a view taken along the line XI—XI in FIG. 9.

The illustrated sheet post-processing apparatus 100 has a function of automatically stapling the sheets fed from the image forming device M. The sheet post-processing apparatus 100 includes a sheet transferring system 120 provided between front and rear frames 101 and 102, a stapling unit 110 for automatically stapling the given sheets, which is incorporated within the rear frame 102, and a driving system 130 for the sheet transferring system, which is incorporated within the front frame 101.

The sheet post-processing apparatus 100 in this embodiment performs required post-processing while leaving the end half part of the stack of sheets inside the apparatus 100 as shown in FIG. 6B. For fulfilling this function, the sheet post-processing apparatus is provided thereinside with a post-processing tray 121 for holding only the end half part of the stack of sheets. As shown in FIG. 10, the post-processing tray 121 is formed aslant beneath a first sheet passage p1 extending from the sheet entrance portion En to the sheet discharge portion Ex. Near the lower end of the post-processing tray 121, there is disposed the aforesaid stapling unit 110.

In this device, the sheets to be stapled by the stapling unit 110 are first sent in the forward direction, and then, sent backward into the post-processing tray 121 (arrow al in FIG. 6A).

The sheet transferring system 120 includes entrance rollers 122, feed rollers 123, and exit rollers 124, which are disposed along the first sheet passage p1. The sheet transferring system 120 further includes a large-diameter resilient feed ring 125 held between the feed rollers 123 so as to rotate in cooperation with the feed rollers. The feed ring 125 has its lower surface coming in elastic contact with the post-processing tray 121.

The first sheet passage p1 branches off on the downstream side of the entrance rollers 122 to form a second sheet passage p2 extending upward. At the branch point of the first and second passages p1 and p2, there is disposed a switching flapper 141, and at the exit of the second sheet passage p2, there is disposed discharge rollers 144. The sheet which need not be processed is sent out to a secondary tray 143 through the second sheet passage p2.

One of each pair of the entrance rollers 122, feed rollers 123 and exit roller 124 is driven to rotate at all times in the forward direction during the operation of the device.

One of the exit rollers 124 at the discharge portion Ex is mounted at the free end of a rocking arm member 126 and comes in detachable contact with the other exit roller. On the rocking arm member 126, there is disposed a paddle 127 selectively rotatable in the reverse direction. Thus, when the sheet is required to be moved in the forward direction, the paired exit rollers 124 being in contact with each other are rotated cooperatively.

In a case of subjecting the sheets to post-processing on the post-processing tray 121, when the sheet being fed through the sheet entrance portion through the first sheet passage passes through the feed rollers 123, the exit rollers 124 are disconnected, and at the same time, the paddle 127 is rotated in the reverse direction opposite to the forward direction. As a result, the sheet traveling along the first sheet passage changes its moving direction and is sent onto the post-processing tray 121.

The post-processing tray 121 is provided with a sheet aligning means 150 for aligning the sheets widthwise. The sheet aligning means 150 comprises an aligning plate 151 for pressing the sheets stacked on the post-processing tray in the lateral direction, and a driving unit 152 including a motor for moving the aligning plate 151 in parallel in the lateral direction.

As shown in FIG. 11, the driving system 130 for the sheet transferring system 120 comprises pulleys 132, 134 and 133 respectively mounted on the rotating shafts of ones of the entrance rollers 122, exit rollers 124 and feed roller 123, a motor 131 for rotating the pulleys 132, 134 and 133 through a belt in one direction, a large gear wheel 135 which is selectively rotated by the pulley 133 of the feed roller 123 through a transmission gear, a rotation control means 136 for selectively rotating the large gear wheel 135, a cam 137 mounted on the large gear wheel 135, a link 138 which reciprocates with the movement of the cam 137 to selectively swing the rocking arm member 126, and a pulley 139 mounted on the rotating shaft of the paddle 127 held by the rocking arm member 126. One of the exit rollers 124 is driven through a transmission gear.

When one sheet is fed from the image forming device M into the sheet post-processing apparatus, the motor 131 is first operated to give rotation to the entrance rollers 122, exit rollers 124 and feed roller 123 in the forward direction through the pulleys 132, 134 and 133 and the belt running around these pulleys, consequently to send the sheet in the forward direction. When no post-processing is necessary, the sheet is sent out to the tray device 1 as it is by continuously rotating the entrance rollers 122, exit rollers 124 and feed rollers 123 in the forward direction.

In the case of aligning and stapling the sheets, when the tail end of the sheet sent into the sheet handling system 100 passes through the feed rollers 123, the rotation control means 136 is operated to rotate the large gear wheel 135, consequently rotating the rocking arm member 126 upward to cause the exit rollers 124 to be separated from each other and neutralized. Simultaneously, the pulley 139 is driven to rotate the paddle 127 in the direction opposite to the forward direction, thus moving the sheet in the reverse direction toward the post-processing tray 121. The sheet introduced onto the post-processing tray 121 is pressed laterally by the sheet aligning means 150 to be aligned along with the sheets previously sent onto the tray. Then, the sheets thus aligned on the post-processing tray are stapled with the stapling unit 110. The stapled sheets are sent out to the tray device 1 by the rotating exit rollers 124.

The aforementioned sheet post-processing apparatus 100 is one example of the sheet handling system to which the tray device of this invention is applied. Therefore, the structure and function of the invention should not be understood as being limited thereto, and it is a matter of course that this invention is applicable to various sheet handling systems of any kind and any type. Also, the device of FIG. 9 has the motor 35 built-in inside the rocking arm 34, but this structure is the substantial same as that of FIG. 1 in which the motor 35 is disposed outside the rocking arm.

As is apparent from the foregoing description, the tray device of the present invention can be made compact and light in weight as the tray driving means capable of moving the sheet supporting plane in parallel in accordance with the thickness of sheets fed onto the sheet supporting plane can be controlled and operated by use of the compact driving mechanism driven by only one motor. Furthermore, a low-power driving means only suffices for operating the tray device of the invention since the sheet supporting plane for carrying the sheets is simple in structure and light in weight. That is, the tray device of the invention can be efficiently operated by a small-size, low-power electric motor. Thus, the tray driving means may be driven by a resilient spring instead of the electric motor, consequently to make the tray device more compact and light in weight. Beside, the tray device of the invention contains all the driving elements thereinside, so as to impose little structural restrictions on a sheet handling system to which the tray device of the invention is united. Thus, this invention is applicable to various sheet handling systems of any kind and any type.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A tray device, which is united to a sheet handling system and used for holding sheets fed from the sheet handling system, comprising a device frame to be attached to said sheet handling system, a tray member for holding one or more sheets thereon, said tray member being movable vertically relative to said device frame, and a tray driving means incorporated within said device frame, said tray driving means including a stationary gear with a rotating shaft held by said device frame, a movable gear with a rotating shaft rotatably held by said tray member, and a tray lifting means for vertically moving the tray member in parallel.

2. The tray device as claimed in claim 1, wherein said tray lifting means is an electric motor.

3. The tray device as claimed in claim 1, wherein said tray lifting means is a spring.

4. A tray device, which is united to a sheet handling system and used for holding sheets fed from the sheet handling system, comprising a device frame to be attached to said sheet handling system, a tray member for holding one or more sheets thereon, said tray member being movable vertically relative to said device frame, and a tray driving means incorporated within said device frame, said tray driving means including a tray lifting means for vertically moving the tray member in parallel, said tray driving means including a stationary gear with a rotating shaft rotatably held by said device frame, a movable gear with a rotating shaft rotatably held by said tray member, a planet gear with a rotating shaft, said planet gear being placed between said stationary gear and said movable gear, and a rocking arm member for supporting said rotating shafts of said stationary gear, movable gear and planet gear, said rocking arm member being rotatable on said rotating shaft of said stationary gear.

5. The tray device as claimed in claim 4, wherein said stationary and movable gears are sector gears.

6. The tray device as claimed in claim 5, wherein said stationary and movable gears are equal in pitch circle radius.

7. A tray device which is united to a sheet discharge side wall of a sheet handling system and used for holding sheets fed from the sheet handling system, comprising a device frame to be attached to said sheet handling system, a tray member for holding one or more sheets thereon, said tray member being movably vertically relative to said device frame, and a tray driving means incorporated within said device frame, said tray driving means including a stationary gear with a rotating shaft rotatably held by said device frame, a movable gear with a rotating shaft rotatably held by said tray member, and a tray lifting means for vertically moving the tray member in parallel, said sheet discharge side wall of said sheet handing system serving as a sheet aligning reference plane with which tail edges of the sheets stacked on said tray member are trued up.

8. The tray device as claimed in claim 7, wherein said device frame of said tray device is provided with a fitting member for being demountably fitted into said sheet handling system.

9. A tray device comprising a device frame, a tray member for holding one or more sheets, said tray member being movable vertically relative to said device frame, and a tray driving means incorporated within said device frame and serving for vertically moving the tray member in parallel, said tray driving means including a stationary gear with a rotating shaft rotatably held by said device frame, a movable gear with a rotating shaft rotatably held by said tray member, a planet gear with a rotating shaft, said planet gear being placed between said stationary gear and said movable gear, and a rocking arm member for supporting said rotating shafts of said stationary gear, movable gear and planet gear, said rocking arm member being rotatable on said rotating shaft of said stationary gear.

* * * * *